United States Patent [19]

Guala

[11] 3,933,284

[45] Jan. 20, 1976

[54] SECURITY BOTTLE CLOSURE DEVICE

[75] Inventor: Piergiacomo Guala, Alessandria, Italy

[73] Assignee: S.A.S. Angelo Guala di Piergiacomo e Roberto Guala & C., Alessandria, Italy

[22] Filed: Oct. 2, 1974

[21] Appl. No.: 511,395

[30] Foreign Application Priority Data

Oct. 17, 1973 Italy ..... 70068/73

[52] U.S. Cl. ..... 222/500

[51] Int. Cl.[2] ..... B65D 5/76

[58] Field of Search ..... 222/500, 541, 182

[56] References Cited

UNITED STATES PATENTS

| | | | |
|---|---|---|---|
| 2,306,309 | 12/1942 | Hall | 222/500 X |
| 2,351,138 | 6/1944 | Lueck | 222/500 X |
| 3,262,600 | 7/1966 | Gach | 222/541 X |

*Primary Examiner*—Allen N. Knowles
*Assistant Examiner*—Norman L. Stack, Jr.
*Attorney, Agent, or Firm*—Sughrue, Rothwell, Mion, Zinn & Macpeak

[57] ABSTRACT

A security closure device for a bottle, which is intended to prevent the fraudulant refilling of a bottle is disclosed. The bottle closure device disclosed has an internal valve which is held shut when the device is in a normal upright position by the weight of a ball which is trapped in a valve chamber between the valve shutter and a plurality of inclined radial ribs. The inclination of the radial ribs is such that when the bottle closure device is held with its axis horizontal the ball rolls down those of the ribs which are lowermost at the time and into engagement with the valve shutter to hold this shut against the valve seat. In order to open the valve it is necessary to tilt the bottle closure device to a position past the horizontal where the ball can roll along the edges of those of the radial ribs which are lowermost at the time to release the valve shutter and allow liquid to flow from the bottle.

2 Claims, 5 Drawing Figures

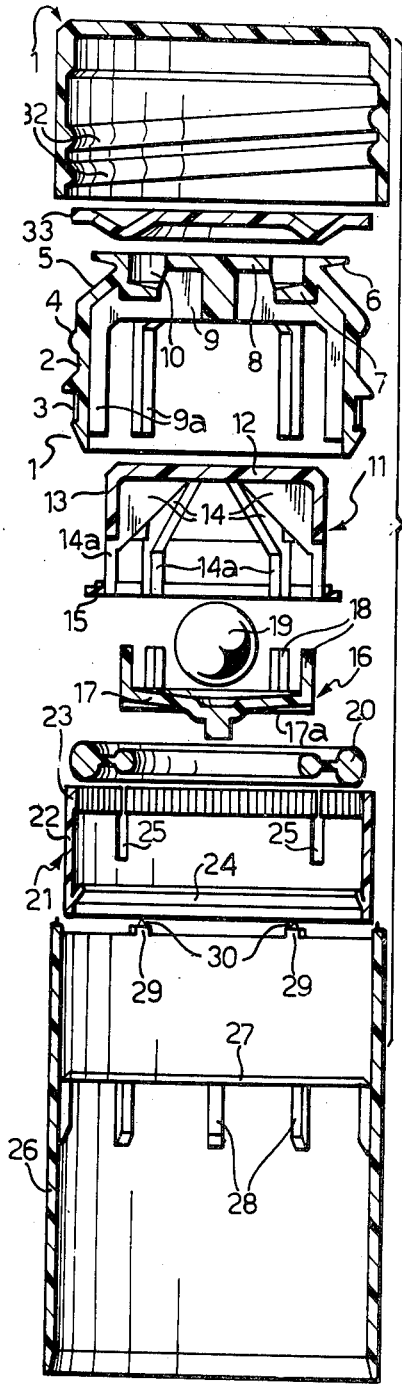
FIG. 1
FIG. 2
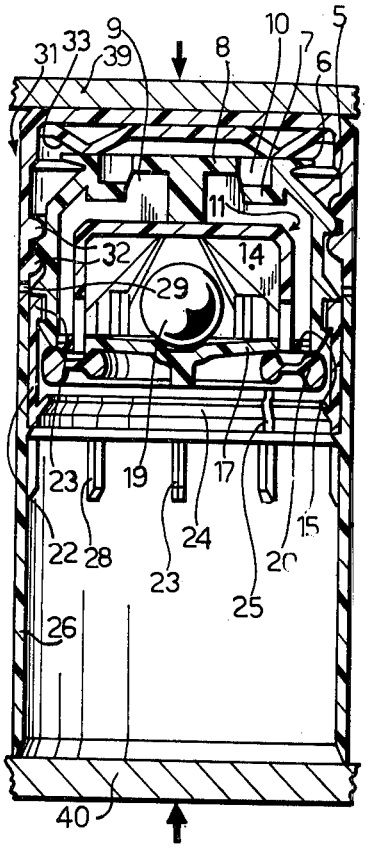
FIG. 3
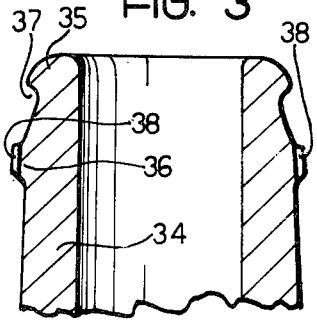

SECURITY BOTTLE CLOSURE DEVICE

BACKGROUND OF THE INVENTION

The present invention relates to a closure device for a bottle, and particularly to a closure device of the type which is intended to prevent fraudulent refilling of the bottle.

Bottle closure devices of the type to which the invention particularly relates comprise a pourer body which is anchored onto the bottle, a screw cap for the pourer body attached by means of frangible bridges to a fixed outer body, which latter is also anchored to the bottle, a movable unidirectional valve on the inside of the pourer body, which valve prevents the passage of liquid therethrough into the inside of the bottle when the bottle is in the upright position, and which allows the liquid to flow from the bottle during pouring, when the bottle is tilted and the device on the neck of the bottle is lower than the remainder of the bottle.

In closure devices of this type the unidirectional valve cooperates with a valve seat which is usually formed by a membrane interposed between the pourer body and the upper end of the neck of the bottle.

However, it has been found that it is possible, with the use of suitable tools, to introduce liquid into the interior of a bottle even when such a security device is fitted. For example, by working with a flexible metal wire through the openings in the pourer body it is possible to dislodge the valve from its seat. Alternatively, by immersing a bottle fitted with a security device into a receptacle which contains the liquid with which it is desired to refill the bottle, and by keeping the bottle in a substantially horizontal position, it is possible to dislodge the valve from the valve seat, and the liquid in which the bottle is immersed can then flow into and partially refill the bottle.

Such devices also have a seal to prevent illicit removal of liquid from the bottle, this seal consists of a number of frangible bridges which connect a screw cap to a fixed part consisting either of a flange which is clamped to the bottle, or else of a tubular portion which surrounds the neck of the bottle, and is locked axially to the neck so as to be securely fixed thereto.

Making a screw cap of this type having a part joined to it by frangible bridges is very difficult due to the complexity of the moulds required.

OBJECTS OF THE INVENTION

One object of this invention is to provide a closure device with a security arrangement of the type described above which does not suffer from the disadvantages outlined above.

Another object of the invention is to provide a device which, when fitted to a bottle will render it impossible to introduce liquid into the bottle by immersing the bottle in a receptable containing the liquid it is desired to introduce into it.

A further object of the invention is to provide a device which, when fitted to a bottle will render it impossible to open the valve to introduce liquid into the bottle by operating with a flexible metal wire through the openings in the pourer.

Yet another object of the invention is to provide a closure device of the type described in which manufacture of the screw cap and of the part joined to it is simplified.

SUMMARY OF THE INVENTION

According to the present invention there is provided a bottle closure device of the type having a valve intended to prevent the introduction of liquid into a bottle to which the device is secured, comprising a pourer body adapted to be positioned on the neck of a bottle, a valve housed within the pourer body and positioned to allow liquid to flow out from the bottle but not into the bottle, and an outer part which is anchored to the body of the bottle, characterized in that there are a plurality of radial ribs within the pourer body, one edge of the ribs being inclined to the axis of the pourer body, and the valve in the pourer body comprises a shutter disc which is axially slidable within the pourer body between a closed position in which it abuts a valve seat and an open position spaced from the valve seat, and a ball interposed between the valve shutter disc and the said radial ribs, the relative positions of the parts being such that the ball rests on the shutter disc to hold this in the closed position by its weight when the pourer body is in the upright position, and when the pourer body is tilted the ball remains in contact with the valve shutter to hold this closed due to its contact with the inclined edges of the said radial ribs unless the pourer body is tilted to a position, past the horizontal, at which the ball can roll along the edges of those of the ribs which are lowermost at the time, thereby allowing the valve to open.

Preferably said pourer body houses an intermediate element, said radial ribs with inclined edges being formed on said intermediate element, a plurality of axial projections on said valve shutter, said projections extending into and being guided by said intermediate element.

In a preferred embodiment said bottle closure device further includes an annular collar for anchoring said pourer body to the neck of a bottle, said collar being provided with at least one longitudinal slit which extends part way along the length thereof and allows a limited radial expansion of said collar upon assembly to the neck of a bottle, a first inner annular projection on said collar, a second inner annular projection on said collar, said second inner annular projection being spaced from said first inner annular projection, an annular groove in said pourer body, said first inner annular projection of said collar engaging in said annular groove in said pourer body, said second inner annular projection of said collar being snap-engageable into an annular groove in the neck of a bottle when the bottle closure device is fitted axially thereto, an outer sleeve of rigid plastics material surrounding said collar, and an inner annular projection on said outer sleeve, the lower edge of said collar abutting against said inner annular projection on said outer sleeve.

It is preferred that the bottom of said annular groove of said pourer body and the crest of said first inner annular projection of said collar are knurled or milled so as to engage with each other to lock said collar and said pourer body against relative angular movement.

There may be further provided a screw cap engaged onto a screw thread on the pourer body, a plurality of frangible links connecting said cap to said sleeve.

Various other features and advantages of the invention will become apparent from the following detailed description which is provided purely by way of non-restrictive example.

BRIEF DESCRIPTION OF THE DRAWINGS

FIG. 1 is an exploded axial section of a closure device for bottles formed as an embodiment of the invention;

FIG. 2 is an axial section of the closure device shown in FIG. 1, illustrating the device prior to being assembled on the neck of a bottle;

FIG. 3 is an axial section of the upper part of the neck of a bottle suitable for use with the closure device illustrated in FIGS. 1 and 2;

DESCRIPTION OF THE PREFERRED EMBODIMENT

Figure 4:
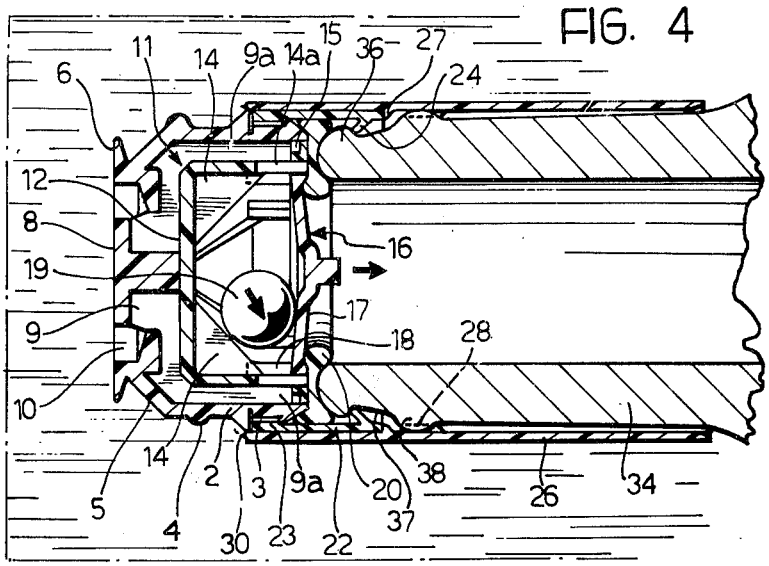
FIG. 4 is an axial section of a closure device in position on the neck of a bottle, showing the relative positions adopted by the various parts of the device when the bottle is placed horizontally.

Referring now to the drawings the closure device shown comprises a plurality of elements which are moulded separately from plastics and assembled together before the device is assembled onto the neck of a bottle. In FIG. 3 there is shown, in section, the neck 34 of a suitable bottle onto which the closure device of the invention can be assembled: this neck has an annular radial projection 35 at the open end thereof, and spaced axially from this a lower annular ridge or projection 36 which defines, between itself and the upper annular projection, an annular groove 37. The lower annular projection or ridge 36 has a plurality of peripheral radial notches 38.

The closure device comprises a pourer body 1 having a cylindrical tubular portion 2 with a radially outwardly facing annular groove 3 extending around the outside thereof adjacent one end. The base of the groove 3 is knurled or milled. The cylindrical tubular portion 2 also has a helical screw thread 4.

The upper end 5 of the tubular portion 2 is conically tapered and is provided with an outwardly flared lip 6 which carries a radially inwardly directed flange 7 having a plurality of radial ribs 9 which, in turn, support a central disc 8. The radial ribs 9 have axial continuations 9*a* extending along the inside of the tubular part 2 of the pourer body 1. The mouth of the pourer body is thus, effectively, partially obstructed by the central disc 8 and this, together with the inwardly directed radial flange 7, forms an annular groove around the mouth of the pourer body, which communicates with the interior of the pourer body through the spaces between the radial ribs 9.

Within the pourer body 1 there is housed an intermediate element 11 which is substantially in the form of an inverted cup with an upper transverse wall 12 and a cylindrical wall 13. The element 11 has a plurality of radially extending triangular ribs 14 two edges of which join the transverse wall 12 and the cylindrical wall respectively, and the free edges of which are inclined so as to approach the transverse wall 12 radially inwardly. The radial ribs 14 have axial continuations 14*a* which extend axially past the lower edge of the cylindrical wall 13 and are connected to an annular element 15 shaped to engage against the lower ends of the axial extensions 9*a* of the radial ribs 9 of the pourer body.

Inside the intermediate element 11 there are located axial projections 18 of a valve shutter 16 comprising a transverse wall 17, having an enlarged rim 17*a*. The axial projections 18 of the valve shutter extend between adjacent radial ribs 14 of the intermediate element 11 and serve to maintain the shutter disc perpendicular to the axis of the pourer body when the shutter is displaced from the valve seat described below. In the inner chamber formed by the intermediate element 11 and the valve shutter 16 there is housed a ball 19 which, in the normal upright position of the bottle, causes the valve shutter to remain in position on the valve seat. This latter consists of a sealing ring 20 of resilient material, interposed between the end of the neck 34 of the bottle and the pourer body 1 and the intermediate element 11.

The pourer body 1 is anchored in position on the neck of the bottle by means of a collar 21, having a cylindrical portion 22 which is provided at its upper end with a radially inwardly projecting annular ridge having a knurled or milled surface for cooperating with the outwardly facing annular groove 3 of the pourer body, and at its lower end with an inclined resilient annular projection 24 which snap engages into the annular groove 37 in the neck of the bottle when the device is assembled onto the neck of the bottle.

The collar 21 has at least one axial slit 25 which extends part way along the axial length of the collar and which allows radial expansion of the collar to facilitate its assembly onto the neck of the bottle. The engagement between the knurling or milling of the annular groove 3 of the pourer body 1 and the knurling or milling of the annular ridge 23 of the collar 21 causes these two parts to engage one another and lock against relative angular movement.

To complete the closure device the collar 21 is surrounded by a tubular sleeve 26 which is fitted over the collar and extends over a part of the neck of the bottle.

This sleeve 26 has a radially inwardly directed annular ridge 27 against which the lower edge of the collar 21 engages, the position of the ridge 27 being such that the collar 21 is entirely contained within the end part of the sleeve 26.

The sleeve 26 is made from a rigid plastics material so that it is impossible to distort the parts either elastically or plastically in order to remove the device forcibly from the neck of the bottle.

If, as described above, the lower annular ridge 36 of the bottle is furnished with radial notches 38, then the sleeve 26 is also provided with inner teeth 28 which engage the notches in order to prevent rotation of the device in relation to the bottle.

To the sleeve 26 there is connected a closure cap 31, furnished with inner threads 32 which cooperate with the outer threads 4 of the pourer body 1. The screw cap 31 and the tubular part 26 are moulded separately (this permits the use of relatively simple moulds) and they are subsequently joined together after assembly of the various parts of the device. In order to effect joining, the tubular part 26 is provided along its upper edge with a number of axial lugs 29 which have small pointed terminal projections 30. The screw cap 31 is pressed against the points 30 of the lugs 29 on the sleeve 26, as shown in FIG. 2, by two plates 39, 40, and the parts are then joined by means of ultrasonic welding between the two parts. The cap 31 is thus secured to the sleeve 26 by the lugs 29 which therefore act as a guarantee seal which prevents illicit opening of a bottle to which the closure device is fitted since the cap 31 can only be removed by breaking the connection between the two parts formed by the lugs 29.

To assemble the closure device to a bottle, the various parts of the device are first assembled together, as shown in FIG. 2, after which the device is forced onto the neck of a bottle: during this operation the resilient annular projection 24 of the collar 21 snap engages in the outwardly facing annular groove 37 of the neck of the bottle so that the device is positioned on the bottle in the securely closed condition. Upon assembly the sealing ring 30 is squeezed between the lower edge of the pourer body and the top of the neck of the bottle.

An inner seal 33 applied to the screw cap 31 ensures hermetic sealing of the bottle by the closure device.

The bottle remains sealed when it is placed in the upright position, that is, vertical, even when the cap 31 is removed, since the weight of the ball 19 presses the valve shutter 16 against the valve seat formed by the sealing ring 30 (see FIG. 2).

Figure 5:
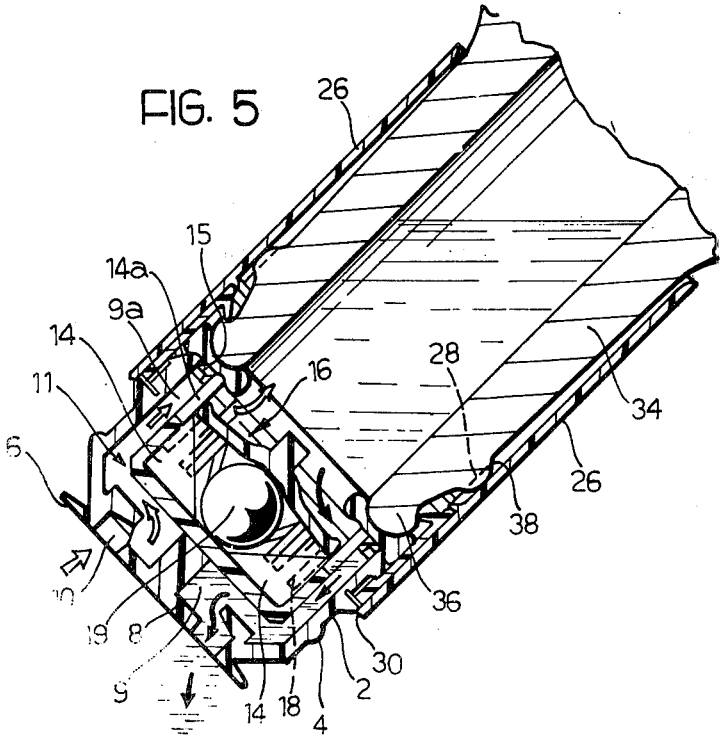
FIG. 5 is an axial section of a closure device showing the device in position on a bottle being tilted to a suitable angle for pouring.

In order to effect pouring, after having removed the screw cap 31 breaking the frangible connection of the lugs 29 to the cap 31, the bottle is tilted, as shown in FIG. 5, in such a way that the free edges of the ribs 14 of the intermediate element, which enclose the ball 19, permit this ball to roll away from the valve shutter disc 17 so that the weight of the shutter disc, together with the thrust exerted upon it by the liquid in the bottle, cause the valve shutter to move away from its seat against the sealing ring 20 allowing the liquid to flow out through the passages between those of the ribs 14 in that part of the pourer body which is lowermost at the time, whilst air enters into the bottle through the passages between those of the ribs 14 which are uppermost at the time. It is not possible fraudulently to refill the bottle by opening the valve with a flexible metal wire, as has previously been the case, since the passage which this wire would have to take to reach the valve shutter is extremely tortuous and even if a wire were introduced through the openings no control of the wire could be exercized to open the valve. Similarly if the bottle is placed horizontally in a receptacle containing the liquid which it is desired to introduce into the bottle, as shown in FIG. 4, the ball 19 is still in contact with the inclined free edges of the ribs 14 of the intermediate element 11, and thus it exerts an axial thrust upon the valve shutter disc 17 which, together with the hydraulic pressure of the liquid in the receptacle, causes the valve to remain closed preventing entry of liquid into the bottle. In order to roll the ball 19 away from the shutter disc 17 it is necessary to tilt the bottle to an extent such that the air within the bottle will not flow out thereby causing an air lock which prevents entry of liquid into the bottle.

What is claimed is:

1. A security closure device for attaching to the neck of a bottle which has an annular groove in the neck, comprising:

a. a pourer body, having an annular groove therein, b. a plurality of radially inwardly protruding ribs located within said pourer body, the innermost edges of said ribs being downwardly divergent when said bottle is in an upright position, c. a valve seat, d. a shutter disc valve which is axially slidable within said pourer body, said disc valve movable between a closed position wherein it abuts said valve seat, and an open position spaced from said valve seat, e. a ball interposed between said shutter disc valve and said radially inwardly protruding ribs, the weight of said ball holding said shutter disc valve in its closed position when the axis of the bottle is vertical or horizontal and allowing the shutter disc valve to open when the axis is tilted past a horizontal position, f. an annular collar attachable to said pourer body, said annular collar having a first inner annular projection for engagement with the annular groove in the bottle neck and a second inner annular projection for engagement with the annular groove in said pourer body, said second annular projection and said annular groove in said pourer body being knurled to prevent relative rotation between said annular collar and said pourer body, g. an outer sleeve surrounding said annular collar, h. a cap threadingly engaged with said pourer body, and i. a plurality of frangible links connecting said cap to said outer sleeve.

2. The bottle closure device of claim 1, wherein said pourer body houses an intermediate element, said radial ribs with inclined edges being formed on said intermediate element, a plurality of axial projections on said valve shutter, said projections extending into and being guided by said intermediate element.

* * * * *